US007636611B2

(12) United States Patent
Huandra

(10) Patent No.: US 7,636,611 B2
(45) Date of Patent: Dec. 22, 2009

(54) FUZZY LOGIC SYSTEM FOR PROCESS CONTROL IN CHEMICAL MECHANICAL POLISHING

(75) Inventor: Sugento Huandra, Austin, TX (US)

(73) Assignees: Samsung Austin Semiconductor, L.P., Austin, TX (US); Samsung Electronics Co., Ltd., Suwon-si (KR)

( * ) Notice: Subject to any disclaimer, the term of this patent is extended or adjusted under 35 U.S.C. 154(b) by 112 days.

(21) Appl. No.: 11/262,028

(22) Filed: Oct. 28, 2005

(65) Prior Publication Data

US 2007/0100489 A1 May 3, 2007

(51) Int. Cl.
*G06F 19/00* (2006.01)

(52) U.S. Cl. ..... 700/121; 700/50; 451/5

(58) Field of Classification Search ..... 700/50, 700/121; 451/5–8, 10, 28; 438/14, 690, 438/692; 216/38, 88
See application file for complete search history.

(56) References Cited

U.S. PATENT DOCUMENTS

| | | | | |
|---|---|---|---|---|
| 5,486,129 | A * | 1/1996 | Sandhu et al. | 451/5 |
| 6,171,174 | B1 | 1/2001 | Campbell et al. | |
| 6,213,848 | B1 * | 4/2001 | Campbell et al. | 451/5 |
| 6,230,069 | B1 * | 5/2001 | Campbell et al. | 700/121 |
| 6,267,644 | B1 * | 7/2001 | Molnar | 451/41 |
| 6,350,179 | B2 | 2/2002 | Campbell et al. | |
| 6,739,944 | B2 * | 5/2004 | Sandhu et al. | 451/5 |
| 6,827,629 | B2 | 12/2004 | Kim et al. | |
| 7,131,890 | B1 * | 11/2006 | Molnar | 451/8 |
| 7,160,739 | B2 * | 1/2007 | Shanmugasundram et al. | 438/14 |
| 2005/0153557 | A1 | 7/2005 | Cho et al. | |

FOREIGN PATENT DOCUMENTS

| | | | |
|---|---|---|---|
| KR | 10-2004-0027898 | A | 4/2004 |
| KR | 10-2005-0050106 | A | 5/2005 |
| KR | 10-2004-0061121 | A | 7/2005 |
| WO | WO 03/030233 | A1 | 4/2003 |

OTHER PUBLICATIONS

Dr. Wang Zhengfeng et al., "Chemical Mechanical Planarization", SIMTech Technical Report (PT/01/003/JT), pp. 1-6.

Albert Hu et al., "Application of Run By Run Controller to The Chemical-Mechanical Planarization Process", Part 1, 1993 IEEE/CHMT Int'l. Electronics Manufacuring Technoogy Symposium, pp. 235-240.

(Continued)

*Primary Examiner*—Charles R Kasenge

(57) ABSTRACT

The present invention provides a versatile system for controlling chemical mechanical polishing in a semiconductor manufacturing process. The system of the present inventions utilizes an in-situ chemical mechanical polishing system, having some type of measurement or metrology function, to bulk polish a semiconductor wafer to a first target threshold. Once the first target has been reached, a fuzzy logic control function, communicatively coupled to the in-situ chemical mechanical polishing system, takes control of further polishing. Measurement data from the measurement function is processed by the fuzzy logic control function, which then adjusts additional polishing time for the polishing system to render a desired wafer topography.

20 Claims, 1 Drawing Sheet

OTHER PUBLICATIONS

Jianfeng Luo et al., "Material Removal Mechanism in Chemical Mechanical Polishing: Theory and Modeling", IEEE Transactions on Semiconductor Manufacturing, vol. 14, No. 2, May 2001, pp. 112-133.

Dipto G. Thakurta et al., "Pad Porosity, Compressibility and Slurry Delivery Effects in Chemical-Mechanical Planarization: Modeling and Experiments", Thin Solid Films, 366, 2000, pp. 181-190.

David A. Chan et al., "Process Control and Monitoring with Laser Interferometry Based Endpoint Detection in Chemical Mechanical Planarization", 1998 IEEE/SEMI Advanced Semiconductor Manufacuring Conference, pp. 377-384.

Dan Simon, "Fuzzy Filtering", Innovatia Software, 1998-2001, http://www.innovatia.com/software/papers/fuzzy.htm, Aug. 26, 2005, pp. 1-5.

Short Term Load Forecasting Using Neural Networks and Fuzzy Logic, http://ceaspub.eas.asu.edu/PowerZone/LoadForecast/fuzzy.htm, Aug. 26, 2005, pp. 1-6.

Anthony J. Toprac et al., Developing and Implementing an Advanced CMP Run-To-Run Controller, http://www.micromagazine.com/archive/03/08/toprac.html, Aug. 25, 2005, pp. 1-10.

* cited by examiner

FUZZY LOGIC SYSTEM FOR PROCESS CONTROL IN CHEMICAL MECHANICAL POLISHING

TECHNICAL FIELD OF THE INVENTION

The present invention relates generally to the field of semiconductor manufacturing processes and, more particularly, to apparatus and methods for controlling processing to effect a desired post-processing topography.

BACKGROUND OF THE INVENTION

The continual demand for enhanced integrated circuit performance has resulted in, among other things, a dramatic reduction of semiconductor device geometries, and continual efforts to optimize the performance of every substructure within any semiconductor device. A number of improvements and innovations in fabrication processes, material composition, and layout of the active circuit levels of a semiconductor device have resulted in very high-density circuit designs. Increasingly dense circuit design has not only improved a number of performance characteristics, it has also increased the importance of, and attention to, semiconductor material properties and behaviors.

The increased packing density of the integrated circuit generates numerous challenges to the semiconductor manufacturing process. Every device must be smaller without damaging the operating characteristics of the integrated circuit devices. High packing density, low heat generation, and low power consumption, with good reliability and long operation life must be maintained without any functional device degradation. Increased packing density of integrated circuits is usually accompanied by smaller feature size.

As integrated circuits become denser, the widths of interconnect layers that connect transistors and other semiconductor devices of the integrated circuit are reduced. As the widths of interconnect layers and semiconductor devices decrease, their resistance increases. As a result, semiconductor manufacturers seek to create smaller and faster devices by using, for example, a copper interconnect instead of a traditional aluminum interconnect. Unfortunately, copper is very difficult to etch in most semiconductor process flows. Therefore, damascene processes have been proposed and implemented to form copper interconnects.

Damascene methods usually involve forming a trench and/or an opening in a dielectric layer that lies beneath and on either side of the copper-containing structures. Once the trenches or openings are formed, a blanket layer of the copper-containing material is formed over the entire device. Electrochemical deposition (ECD) is typically the only practical method to form a blanket layer of copper. The thickness of such a layer must be at least as thick as the deepest trench or opening. After the trenches or openings are filled with the copper-containing material, the copper-containing material over them is removed, e.g., by chemical-mechanical planarization or polishing (CMP), so as to leave the copper containing material in the trenches and openings but not over the dielectric or over the uppermost portion of the trench or opening.

During CMP, copper and the adjacent dielectric are removed from the wafer at different rates. Typically, a copper-selective chemical slurry is applied, after which a first round of polishing occurs. Then, a dielectric-selective slurry is applied, followed by more polishing. This process creates certain surface anomalies, and a varying post-CMP topography. A number of factors, including pattern geometry (e.g., copper line density), affect the removal rates and add to the surface anomalies. One common surface anomaly that occurs with copper CMP is dishing. Dishing occurs when the copper recedes below or protrudes above the level of the adjacent dielectric. Theoretically, the goal of the CMP process is to achieve a flat post-CMP topography, as excessive dishing can negatively impact process yields. In practice, however, some processes may achieve more optimal yields with a slight, or even moderate, amount of dishing. Regardless of whether a flat or slightly dished topology is desired, the ability to monitor and actively control the amount of dishing is critical to achieving optimal process yields.

A number of conventional methods exist by which post-CMP topography is managed or regulated. Typically, such methods include some process for predicting or measuring polish rate, and some mechanism that uses that polish rate to calculate a required total polish time.

Unfortunately, a number of such conventional methods either fail to account for, or insufficiently account for, a number of complex multi-variable interactions that can significantly impact a CMP process—such as pad conditioning, CMP environmental factors (e.g., temperature), slurry composition or material degradation. In order for a conventional system to adequately account for such variables, an accurate complex multi-variable model would be required. Developing such an accurate model, if possible at all, would be a very labor-intensive task. Furthermore, such a model would require extensive data and behavioral maintenance. Thus, frequently, conventional CMP processes rely on simple, best-guess models or historical data extrapolations.

In the absence of a highly accurate polishing rate model, however, a number of processes may fail to polish a device with acceptable accuracy—particularly where stringent process specifications exist (e.g., shallow trench isolation devices). Even nominal variations between predicted polish rates and actual polish rates can yield significant under or over polish results. Where such results are recognized, process overhead may be increased, as under-polished wafers must undergo some remediation, or process yields may suffer as over-polished wafers are scrapped. Where such results are not recognized, device reliability and yields may suffer.

As a result, there is a need for a versatile system for controlling the post-CMP topology of a semiconductor wafer—a system that provides direct and dynamic control of CMP processing in an easy, efficient and cost-effective manner.

SUMMARY OF THE INVENTION

The present invention provides a versatile system for controlling the post-processing topology of a semiconductor wafer in an easy, efficient and cost-effective manner. The present invention is particularly applicable to controlling the post-CMP topology of a semiconductor wafer. The present invention provides direct control of CMP processing, responsive—in a dynamic or quasi-dynamic fashion—to a metrology or profilometry evaluation.

The present invention provides a system that may easily be integrated with high-volume semiconductor manufacturing processes. The system of the present invention provides control subsystems that manage CMP processes in a desired manner. The control subsystems of the present invention cooperate with a metrology or profilometry evaluation system—one that provides accurate and timely data regarding current post-CMP topology—to determine CMP modifications necessary to effect a desired post-CMP topology. The present invention thus optimizes CMP processing to provide desired post-CMP topologies in an efficient and effective manner, overcoming certain limitations commonly associated with a number of conventional systems.

More specifically, the present invention provides a versatile system for controlling chemical mechanical polishing in a semiconductor manufacturing process. The system of the present invention utilizes an in-situ chemical mechanical polishing system, having some type of measurement or metrology function, to bulk polish a semiconductor wafer to a first target threshold. One example of this type of system is disclosed in U.S. Pat. No. 6,827,629 entitled "Method Of And Apparatus For Controlling The Chemical Mechanical Polishing Of Multiple Layers On A Substrate" which is commonly assigned with, and hereby incorporated into this application. Once the first target has been reached, a fuzzy logic control function, communicatively coupled to the in-situ chemical mechanical polishing system, takes control of further polishing. Measurement data from the measurement function is processed by the fuzzy logic control function, which then adjusts additional polishing time for the polishing system to render a desired wafer topography.

Other features and advantages of the present invention will be apparent to those of ordinary skill in the art upon reference to the following detailed description taken in conjunction with the accompanying drawings.

BRIEF DESCRIPTION OF THE DRAWINGS

For a better understanding of the invention, and to show by way of example how the same may be carried into effect, reference is now made to the detailed description of the invention along with the accompanying figures in which corresponding numerals in the different figures refer to corresponding parts and in which.

DETAILED DESCRIPTION OF THE INVENTION

Figure 1:
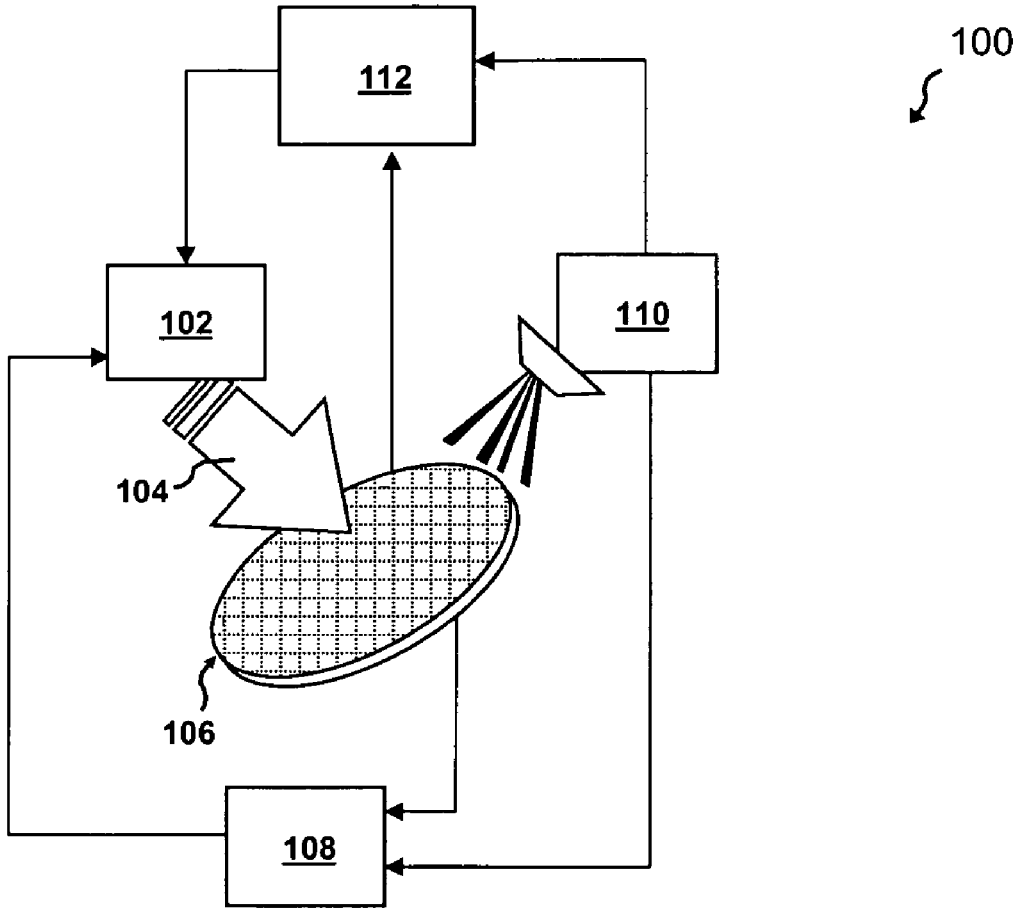
FIG. 1 provides an illustration of one embodiment of a chemical mechanical polishing system according to the present invention.

While the making and using of various embodiments of the present invention are discussed in detail below, it should be appreciated that the present invention provides many applicable inventive concepts, which can be embodied in a wide variety of specific contexts. The present invention is hereafter illustratively described in conjunction with the operation and control of chemical-mechanical planarization or polishing (CMP) within a semiconductor manufacturing process. Although described in relation to such apparatus and methods, the teachings and embodiments of the present invention may be beneficially implemented with a variety of manufacturing and automated polishing applications. The specific embodiments discussed herein are, therefore, merely demonstrative of specific ways to make and use the invention, and do not limit the scope of the invention.

The present invention provides a versatile system for controlling the post-processing topology of a semiconductor wafer in an easy, efficient and cost-effective manner. The present invention is particularly suitable for controlling post-CMP topology of a semiconductor wafer. The present invention provides direct control of CMP processing, responsive—in a dynamic or quasi-dynamic fashion—to a wafer surface topology evaluation.

A number of conventional methods exist by which post-CMP topology can be measured or profiled. Typically, such characterization is referred to as metrology. Any suitable metrology system or method may be used in accordance with the present invention. However, certain practical considerations may weigh in favor of or against different methods, depending upon requirements or restrictions of a given manufacturer. A number of different in-situ metrology methods are available for semiconductor manufacturing. Some such methods require surface contact with the wafer, but may be deleterious in nature. Some methods rely on temperature or friction based profiling or measurement. Still other metrology systems, such as an In-Situ Rate Monitoring (ISRM™) system from Applied Materials, are non-contact in nature—relying on optical, laser-based measurement of device features.

Unfortunately, however, current metrology systems usually provide only the ability to render a relative physical measurement or characterization of post-CMP topography. They typically do not provide an ability to actively control CMP processes based on real-time metrology data.

There are certain existing methods that attempt to modify post-CMP topologies in response to metrology data. Unfortunately, there are certain drawbacks associated with each. Most conventional methods either require additional processing steps or changes to device layout and design—adding costs to and reducing the efficiency of production processes. These approaches augment, instead of optimize, the already existing process steps.

Furthermore, many such conventional methods tend to be rather static in nature. Dynamic management of CMP on a spot-to-spot, wafer-to-wafer, or even lot-to-lot, basis in order to address subtle variations in metrology data is simply not possible or not operationally feasible. The substantial effort and cost associated with modifying the CMP process often translates into substantial yield losses to dishing before a change can be justified. Also, many conventional systems are not designed for concurrent, cooperative operation of metrology and CMP control components.

In contrast, the present invention provides a system that may easily be integrated with high-volume semiconductor manufacturing processes. The system of the present invention provides a fuzzy logic control subsystem that manages a CMP process—particularly overpolish—in a desired manner. The control subsystem cooperates with already existing, or new, metrology or polishing systems. The present invention thus optimizes CMP processing to provide desired post-CMP topographies in an efficient and effective manner.

The system of the present invention provides certain modeling and control subsystems that cooperate, or may be integrated, with polishing or metrology evaluation system. Although there are a number of possible embodiments, especially for metrology equipment or systems, the metrology system of the present invention must provide accurate and timely data regarding wafer topographies, especially current and recent post-CMP topographies.

The present invention utilizes the current/recent data to determine what CMP modification or supplementation may be necessary to effect a desired post-CMP topography. The present invention thus optimizes CMP processing to provide desired post-CMP topographical properties.

In certain embodiments of the present invention, CMP is conducted in two consecutive stages. Depending upon design, manufacturing or test constraints, these two stages may be immediately consecutive, or may be separated by some interval of time. The first such stage uses standard in-situ metrology and CMP systems to bulk polish a wafer surface down to some first target threshold (e.g., certain feature thickness). Once that threshold has been reached, a fuzzy logic control system manages the polish/overpolish performed until a second, final target thickness is achieved.

For purposes of explanation and illustration, consider a CMP process utilizing an ISRM™ metrology system. Generally, ISRM™ metrology correlates the relative strength of an optical signal to the change in thickness of a polished layer or surface. With such a metrology system, an almost zero-degree slope (i.e., flat peak or valley) on an endpoint trace would be optimal for consistent measurement of post-polish thickness.

Since the first target threshold does not necessarily coincide with a peak or valley on an endpoint trace, an overpolish by time may be added at the end of the bulk polish, to polish the surface to the final target thickness. The fuzzy logic control system of the present invention manages this phase.

The present invention is described in greater detail now with reference to FIG. 1, which depicts one embodiment of a semiconductor processing system 100 according to the present invention. System 100 comprises a polishing function 102 that performs CMP 104 on a semiconductor wafer 106. Initial data on the incoming thickness of wafer 106 is communicated to a bulk polish control function 108. An initial polish target is further communicated to or stored in function 108. Function 108 receives current thickness or topographic information from a measurement function 110.

Function 110 may comprise any suitable metrology or profilometry system or apparatus. For purposes of illustration and explanation, function 110 is depicted as a non-contact, laser-based metrology system. In alternative embodiments, function 110 may comprise a stylus-based profilometer, or some other contact-based metrology system. All such variations are comprehended herein.

Function 108 provides a control signal to function 102 to perform a bulk polish on wafer 106. Function 108 utilizes a suitable operational system (e.g., ISRM) to process measurement data from function 110 as it controls function 102. Once the initial polish target has been reached, function 108 cedes control of function 102 to fuzzy logic control function 112. Information is communicated to function 112 regarding the most recent measurement data for wafer 106, measurement data from some number of previous measurements, and an indication of polishing rate. Function 112 may calculate or determine polishing rate internally, or such data may be provided to function 112 from some external source (e.g., function 108). Function 112 is also provided with a final, post-CMP topography target.

Function 112 analyzes and processes the measurement and polishing rate data against the final target. Based on a comparison of the final target against current measurement, recent measurement, and rate of polish data, function 112 signals function 102 to adjust its polishing. For example, if function 112 determines that the final target is nearly reached, it may signal function 102 to slow the polishing down. If a significant difference between the final target and current measurement exists, then function 112 may signal function 102 to increase polish speed or pressure.

Function 112 operates based on a fuzzy logic system. Fuzzy systems are computing frameworks based on concepts of "fuzzy set theory", "fuzzy if then rules" and "fuzzy reasoning". A fuzzy inference process consists of three conceptual components: 1) a rule base, containing a selection of fuzzy rules; 2) a database, defining certain membership functions; and 3) a reasoning function, that performs the inference procedure upon the rules and given facts, and derives a reasonable output or conclusion.

Sometimes, as in the case of a processing control system, it is necessary to extract a crisp value that best represents the fuzzy output. With crisp inputs and outputs, a fuzzy expert system implements a non-linear mapping from the input space to the output space. This mapping is accomplished by a number of if-then rules, each of which describes a local behavior of the mapping.

For example, consider a set of data or objects X. Another set containing data (or objects) is represented by A. An individual value of the data set X is represented by x. $\mu_A(x)$ is a membership function that connects sets X and A. The value of membership function $\mu_A(x)$ varies between 0 and 1, and determines the degree to which x belongs to A. A high value of $\mu_A(x)$ means that it is very likely that x is in A.

Generally, there are four basic membership functions: 1) triangular; 2) trapezoidal; 3) Gaussian; and 4) generalized bell. The triangular function—"A=triangle (x, a, b, c)"—may be defined as:

$$A = \begin{cases} 0, & x \le a \\ (x-a)/(b-a), & x \in (a, b) \\ (c-x)/(c-b), & x \in (b, c) \\ 0, & x \ge c \end{cases}$$

This function has three parameters—"a" (minimum), "b" (middle) and "c" (maximum)—that determine the shape of the triangle.

A trapezoidal membership function—"A=trapezoid (x, a, b, c, d)"—may be defined as:

$$A = \begin{cases} 0, & x \le a \\ (x-a)/(b-a), & x \in (a, b) \\ 1, & x \in (b, c) \\ (d-x)/(d-c), & x \in (c, d) \end{cases}$$

This function has four parameters "a", "b", "c" and "d" that determine the shape of the trapezoid. Similar definitions for Gaussian and generalized bell functions may be provided. Membership functions are not restricted to just these four. A membership function can be produced for any desired characteristic, system, or set of variables. If desired or required, multi-dimensional membership functions may be utilized.

For the embodiment represented by function 112, operation is based on three inputs: current thickness, polishing momentum or rate, and an average of three most current thickness measurements. A good estimate for next polish rate may be obtained from the most current polish rate—therefore current thickness is one of the inputs. Polishing momentum is provided to monitor the rate of change in material thickness. Rapid thickness correction is undesirable, since overshoot may occur causing an unstable process. An average of three most current thickness measurements is provided, to dampen the effect of any anomalous reading. In other embodiments, any suitable desired number of measurements may be averaged.

For this embodiment, a Gaussian bell membership function may be provided for the inputs, and a triangle membership function for the outputs. The Gaussian bell has three tuning parameters, while the triangle has two. A set of rules may be provided such that: 1) if thickness is on target, then no time change results; 2) if thickness is acceptable and momentum is stable, negative or positive, then time change is a small decrease, small decrease or no change, respectively; and 3) if thickness is either thick or thin, and the average of the previous measurements was on target, then time change is a small increase or a small decrease, respectively.

Depending upon the nature of the processes and systems components utilized, there can be a very substantial number of tuning parameters to be set. Once these parameters are set, however, the system of the present invention will operate without a re-tuning. These parameters may be preset based on human knowledge of the process.

Once more data is gathered during processing, the parameters can be fine-tuned by the fuzzy control function if the preset values are unsatisfactory, using a suitable fuzzy logic algorithm or construct (e.g., Adaptive Neuro-Fuzzy Inference System (ANFIS)). The number of tuning parameters may increase depending upon the number of inputs, type of membership function, and number of rules. By processing based on polish and material removal rates, the system of the present invention obviates the need for adjustments due to CMP variables (e.g., process variations, consumable variations).

System 100 and each of its constituent functions, particularly function 112, may be implemented in a variety of ways. Each such function may comprise various hardware or software constructs, or combinations of both, implemented as stand-alone or integrated functions. For example, function 112 may be implemented with a stand-alone computer or server equipped with an appropriate fuzzy logic software, such as MATLAB™. Function 112 may, in alternative embodiments, be implemented as a specialized fuzzy logic processing device (e.g., stand-alone semiconductor device). The constituent functions of system 100 may also be implemented in physically collocated or separate structures. Functions requiring physical manipulation or action may be implemented in hardware, while remaining functions are implemented as software constructs operable on a host processing capability. Other similar variations and combinations are comprehended by the present invention.

Thus, according to the present invention, a semiconductor processing system (i.e., a CMP processing system) may be augmented to provide selective, dynamic control of resulting wafer topologies. The present invention utilizes specific historical real-time data to provide optimal CMP process control. The present invention utilizes fuzzy logic in parallel with in-situ metrology or measurement systems to determine appropriate total polish time in a closed-loop run-to-run control system.

The embodiments and examples set forth herein are presented to best explain the present invention and its practical application and to thereby enable those skilled in the art to make and utilize the invention. However, those skilled in the art will recognize that the foregoing description and examples have been presented for the purpose of illustration and example only. The description as set forth is not intended to be exhaustive or to limit the invention to the precise form disclosed. Many modifications and variations are possible in light of the above teaching without departing from the spirit and scope of the following claims.

What is claimed is:

1. A hardware fuzzy logic processing device implementing a fuzzy logic control function for a chemical mechanical polishing system, comprising:

an input device for receiving input data concerning current thickness, polishing momentum or rate, and an average of at least three most current thickness measurements for a semiconductor wafer being polished;

a membership function for output data;

a rule base; and a fuzzy processing function for performing an inference procedure according to the rule base and the input data and for mapping a result of the fuzzy processing function into the output data membership function to determine a time adjustment for polishing of the semiconductor wafer.

2. The hardware fuzzy logic processing device of claim 1, wherein the fuzzy processing function is connected to control a polishing function adapted to perform a chemical mechanical polishing process on the semiconductor wafer.

3. The hardware fuzzy logic processing device of claim 1, wherein the input device is connected to a rate monitoring system.

4. The hardware fuzzy logic processing device of claim 1, wherein the received data comprises incoming thickness data for the semiconductor wafer.

5. The hardware fuzzy logic processing device of claim 1, wherein the received data comprises data from a metrology system.

6. The hardware fuzzy logic processing device of claim 1, wherein the received data comprises data from a profilometer.

7. The hardware fuzzy logic processing device of claim 1, wherein the received data comprises data from a non-contact based metrology system.

8. The hardware fuzzy logic processing device of claim 1, wherein the received data comprises data from a laser-based metrology system.

9. The hardware fuzzy logic processing device of claim 1, wherein the fuzzy processing function comprises software operating on a host processor system.

10. The hardware fuzzy logic processing device of claim 1, wherein the fuzzy processing function comprises a specialized processor device.

11. The hardware fuzzy logic processing device of claim 1, wherein the received data comprises a first target threshold.

12. The hardware fuzzy logic processing device of claim 1, wherein the received data comprises:

a current measurement of the semiconductor wafer;

a plurality of recent measurements of the semiconductor wafer; and a polishing rate indicator.

13. The hardware fuzzy logic processing device of claim 1, wherein the received data comprises a final topography target.

14. A hardware fuzzy logic processing device implementing a fuzzy logic control function for a chemical mechanical polishing system, comprising:

an input device for receiving input data concerning current thickness, polishing momentum or rate, a current measurement of the semiconductor wafer, a polishing rate indicator, and an average of at least three most current thickness measurements for a semiconductor wafer being polished;

a membership function for output data;

a rule base; and a fuzzy processing function for performing an inference procedure according to the rule base and the input data and for mapping a result of the fuzzy processing function into the output data membership function to determine a time adjustment for polishing of the semiconductor wafer.

15. The hardware fuzzy logic processing device of claim 14, wherein the received data comprises data from a laser-based metrology system.

16. The hardware fuzzy logic processing device of claim 14, wherein the fuzzy processing function comprises software operating on a host processor system.

17. The hardware fuzzy logic processing device of claim 14, wherein the fuzzy processing function comprises a specialized processor device.

18. The hardware fuzzy logic processing device of claim 14, wherein the received data comprises a first target threshold.

19. The hardware fuzzy logic processing device of claim 14, wherein the received data comprises a final topography target.

20. The hardware fuzzy logic processing device of claim 14, wherein the received data comprises incoming thickness data for the semiconductor wafer.

* * * * *

UNITED STATES PATENT AND TRADEMARK OFFICE

CERTIFICATE OF CORRECTION

PATENT NO. : 7,636,611 B2
APPLICATION NO. : 11/262028
DATED : December 22, 2009
INVENTOR(S) : Sugento Huandra It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 243 days.

Signed and Sealed this

Twenty-first Day of December, 2010

David J. Kappos

David J. Kappos
*Director of the United States Patent and Trademark Office*